US006588052B2

(12) United States Patent
Iversen

(10) Patent No.: US 6,588,052 B2
(45) Date of Patent: Jul. 8, 2003

(54) VACUUM HOSE AND CORD HOLDER

(76) Inventor: Edward P. Iversen, 14 Woodview La., Algonquin, IL (US) 60102

( * ) Notice: Subject to any disclaimer, the term of this patent is extended or adjusted under 35 U.S.C. 154(b) by 0 days.

(21) Appl. No.: 10/195,634

(22) Filed: Jul. 15, 2002

(65) Prior Publication Data

US 2002/0178530 A1 Dec. 5, 2002

Related U.S. Application Data

(63) Continuation-in-part of application No. 09/864,796, filed on May 24, 2001, now Pat. No. 6,502,276.

(51) Int. Cl.[7] ..... A47L 9/26

(52) U.S. Cl. ..... 15/323; 15/246.2; 248/51; 248/52; 248/75; 248/79

(58) Field of Search ..... 15/323, 246.2; 248/51, 52, 75, 79

(56) References Cited

U.S. PATENT DOCUMENTS 1,896,933 A * 2/1933 Anastasi ..... 15/323
1,970,576 A * 8/1934 Replogle et al. ..... 15/323
2,173,696 A * 9/1939 Gorham ..... 249/73
2,450,172 A * 9/1948 Stoner ..... 15/323
2,935,760 A * 5/1960 Martinec ..... 15/323
4,541,142 A * 9/1985 Pudwill ..... 15/323
5,137,156 A * 8/1992 Riczinger et al. ..... 15/323
6,058,559 A * 5/2000 Yoshimi et al. ..... 15/323
6,079,080 A * 6/2000 Rutter et al. ..... 15/323

* cited by examiner

*Primary Examiner*—Theresa T. Snider
(74) *Attorney, Agent, or Firm*—Mathew R. P. Perrone

(57) ABSTRACT

A vacuum cord and hose holder has a base with a vacuum cord and hose support, which includes a pair of oppositely disposed wings protruding upwardly therefrom to support the vacuum hose and cord; on one wing is the cord hook; a standard hose extension to facilitate storage of the extra-long shop vacuum hose and a mount which provides for a means of attaching the vacuum cord and hose support to the vacuum.

20 Claims, 3 Drawing Sheets

VACUUM HOSE AND CORD HOLDER

CROSS REFERENCE TO RELATED APPLICATIONS

This application is a continuation in part of U.S. patent application Ser. No. 09/864,796 filed May 24, 2001; being filed by the same inventor, and incorporated herein by reference, now U.S. Pat. No. 6,502,276 issued Jan. 7, 2003.

This invention relates to a vacuum cord and hose holder and more particularly to a vacuum cord and hose holder for use with any vacuum cleaner, especially a vacuum cleaner suitable for cleaning a shop area.

BACKGROUND OF THE INVENTION

A vacuum cleaner is a well-known device for cleaning a number of different surfaces. Such a device may be used in a home, in a vehicle, in an industrial setting, or any setting, which requires removal of undesirable material from a surface. Commonly, an industrial setting uses a type of vacuum cleaner, commonly called a shop vacuum, which functions well in an extremely dirty situation.

In a workshop, a shop vacuum, with its extra-long hose and electric power cord, becomes difficult to store. Most, if not all manufactured shop vacuums have no storage devices for the vacuum hose or the electrical cord. It is very desirable to minimize the storage difficulties, while at the same time, keeping the cord and hose ready for use.

Many storage devices are known for the electrical cord and vacuum hose for non-shop vacuums. Most of these prior art devices suffer from the defect of being difficult to use and being ineffective. Critical features of a storage device for a cord and a hose of a vacuum cleaner are the ease of placing the hose and the cord in the storage device and the reverse operation of removing the cord and the hose from the storage device for efficient use.

Unfortunately, most of the storage devices of the prior art are difficult to use in either direction. Great care must be used whether the cord and the hose are being stored in the device or removed therefrom. The storage device having ease of storage provides difficult removal. The storage device having ease of removal therefrom provides difficult storage. It is a great advantage to overcome the obstacles resulting therefrom.

Another major difficulty of the hose and cord storage device is the difficulty of applying such a device to an existing vacuum cleaner. This hose and cord storage device must be easily applied to the vacuum cleaner without causing interference of the function thereof. It must also be easily attachable thereto.

Applicant's device, as described in his parent patent application, solves a number of problems in the prior art. However, with the typical shop vacuum's extended length hose and power cord, an adverse dragging effect is still possible.

Thus, an additional improvement encompassing an extended height of the storage device to facilitate the storage of the extended length shop vacuum hose or power cord is still required. No such device for attaching an extended storage device to a shop vacuum is known the prior art.

SUMMARY OF THE INVENTION

Among the many objectives of this invention is the provision of a vacuum cord and hose holder providing both ease of removal and ease of storage.

Another objective of this invention is to provide a movable vacuum cord and hose holder.

Yet another objective of this invention is to provide a vacuum cord and hose holder, which is easily attached an existing vacuum cleaner.

Additionally, an objective of this invention is to a vacuum cord and hose holder for a heavy-duty shop vacuum cleaner.

Also, an objective of this invention is to provide a vacuum cord and hose holder with minimized interference with the vacuum cleaner.

A still further objective of this invention is to provide a vacuum cord and hose holder adapted to receive the vacuum hose easily.

Yet a further objective of this invention is to provide a vacuum cord and hose holder adapted to receive the cord easily.

These and other objectives of the invention (which other objectives become clear by consideration of the specification, claims and drawings as a whole) are met by providing a vacuum cord and hose holder, the vacuum cord and hose holder including a base with a pair of oppositely disposed wings protruding upwardly therefrom to support the vacuum hose. Adjacent to each of the wings is an arcuate slot, providing a pair of arcuate slots adapted to receive the vacuum hose. On one wing is the cord hook, in which the vacuum cord may be received for storage.

BRIEF DESCRIPTION OF DRAWINGS

Throughout the figures of the drawings where the same part of appears in more than one figure, the same number is applied thereto.

DESCRIPTION OF PREFERRED EMBODIMENTS

Figure 1:
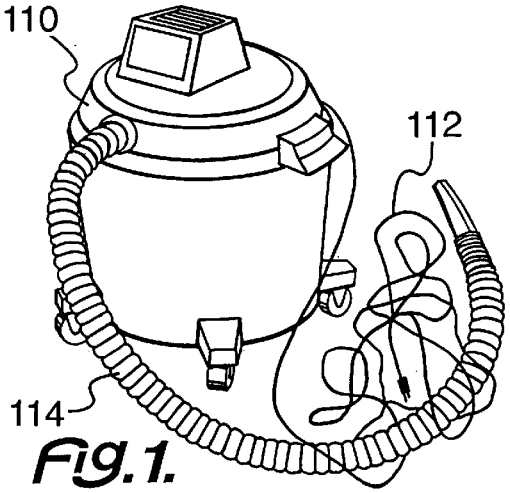
FIG. 1 depicts a perspective view of vacuum cleaner 110 in a standard disarray.

The hose and cord holder consists of three parts, a vacuum hose and cord support, a wand and a mount. A vacuum cord and hose support uses a pair of opposing wings extending from a base. Mounted on one of the opposing wings is a cord hanger adapted to receive an electrical cord. Thus, the vacuum cord and hose support provides a convenient place to store those items on a vacuum cleaner.

This vacuum cord and hose support is attached to the wand by means of male or female fitting as desired. The standard hose extension facilitates the storage of the extra-long shop vacuum hose. The wand is connected to the mount by means of a male to female fitting. The mount may be connected to the vacuum cleaner in any suitable fashion. It may be secured by tape, glue, a screw, a nut and bolt, a hook and loop assembly, another fastener, or combinations thereof.

Another preferred embodiment of the cord and hose support includes of the same three parts with the male/female fittings reversed. A third preferred embodiment includes the hose and cord support situated directly upon the mount, excluding the wand.

While it is not desired to be bound by any particular theory, it is believed that the tapered edge of the vacuum hose and cord support assists in receiving the hose, when the hose is merely tossed at the vacuum cord and hose holder.

A vacuum cord and hose holder uses a pair of opposing wings extending from a base. Mounted on one of the opposing wings is a cord hanger adapted to receive a cord. Thus, the vacuum cord and hose holder provides a convenient place to store those items on a vacuum cleaner.

In a preferred form, the vacuum cord and hose holder has the wand to raise the hose and cord support above the top of the shop vacuum. This increased height facilitates for more efficient storage of the extra-long shop vacuum hose.

In a preferred form, the vacuum cord and hose support is a hollow truncated pyramid. The base is at what would be the top of a truncated pyramid. In use on the vacuum cleaner, the truncated pyramid appears upside down.

Further for the preferred form, as the hose receiver is formed in two opposing walls of the truncated pyramid, it has two arcuate, generally parabolic and symmetrical shapes, and oppositely disposed shapes. The first wing and the second wing form two opposing walls of the truncated pyramid.

In the first wing preferably is a centrally located indentation extending substantially vertically from the base of the vacuum cord and hose holder. The cord holder is situated therein. Thus, the cord may he stored between the cord holder and the first wing.

The vacuum cord and hose holder mount may be secured on the vacuum cleaner in any satiable fashion. It may be secured by tape, glue, a screw, a nut and bolt, a hook and loop assembly, another fastener, or combinations.

While it is not desired to be bound by any particular theory, it is believed that the tapered edge of the hose receiver in the vacuum cord and hose support assists in receiving the hose, when the hose is merely tossed at the vacuum cord and hose holder. The four upwardly extending ribs or edges of the slot assist in receiving the convolutions present in the vacuum hose and hence the vacuum hose itself.

Figure 2:
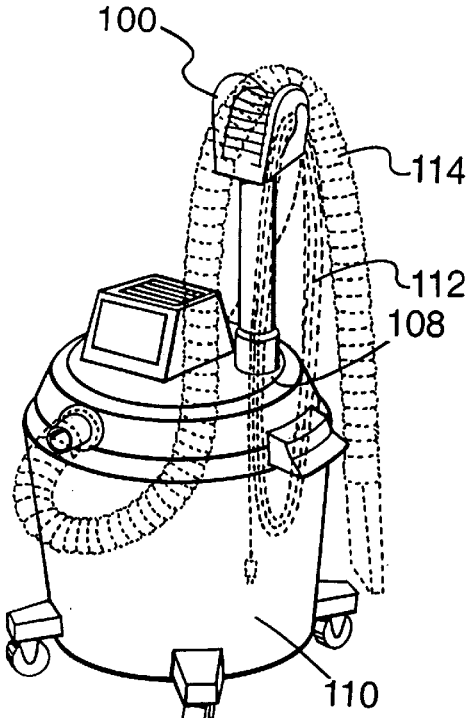
FIG. 2 depicts a perspective view of vacuum cleaner 110 with hose and cord holder 100 mounted upon it with the electrical cord and hose from the vacuum cleaner 110 placed in the vacuum hose and cord support 180.

Referring now to FIG. 1 and FIG. 2, a comparison therebetween, shows that the vacuum cord and hose holder 100 is extremely useful. In FIG. 1, vacuum cleaner 110 has cord 112 and hose 114 laying in disarray. With FIG. 2 showing vacuum cord and hose holder 100 mounted on a top portion 108 of a vacuum cleaner 110, vacuum cord 112 and vacuum hose 114 may be neatly stored and ready for further use. The vacuum cord and hose holder 100 is suitable for any type of vacuum cleaner, with vacuum cleaner 110 shown herein being a preferred use therefor.

Figure 3:
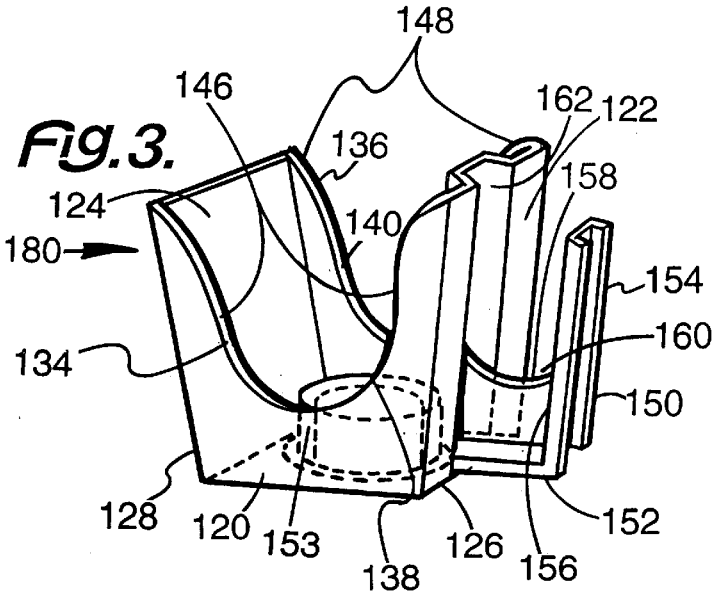
FIG. 3 depicts a perspective view of the vacuum hose and cord support 180.

Adding FIG. 3 to the consideration, the vacuum cord and hose support 180 is displayed. Vacuum cord and hose support 180 has a base 120 that is preferably rectangular in shape, although other shapes are operable.

Extending upwardly from base 120 is a first wing 122 Oppositely disposed from first wing 122 is second wing 124. Clearly, first wing 122 extends from first wing side 126 of base 120. Clearly, second wing 124 extends from second wing side 128 of base 120.

Extending upwardly from base 120 is a first wing 122. Oppositely disposed from first wing 122 is second wing 124. Clearly, first wing 122 extends from first wing side 126 of base 120. Clearly, second wing 124 extends from second wing side 128 of base 120.

Vacuum cord and hose support 180 also has a first slot side 134 oppositely disposed from a second slot side 136. While first slot side 134 and second slot side 136 are similar in appearance, objectively, they resemble wings 122 and 124 with a first arcuate slot 138 in first slot side 134 and second arcuate slot 140 and second slot side 136.

First slot side 134 and second slot side are similar in structure. First slot side 134 has a first rib pair 146 adapted to receive the hose 114 therebetween. Second slot side is similar in structure and includes second rib pair 148. Second rib pair 148 cooperates with first rib pair 146 and tapered edges thereof to receive hose 114 therebetween. With this design, it is possible to place hose 114 therebetween with a mere toss.

Extending from first wing 122 is power cord hanger 150. Power cord hanger 150 has a wing base 152 extending therefrom. Wing base 152 provides spacing from first wing 122 and permits power cord arm 154 to extend upwardly therefrom and spaced apart from first wing 122. If desired, hanger buttress 156 may provide support between wing base 152, power cord arm 154 and first wing 122. Hanger buttress 156 may have a top arc 158 in order to permit power cord 114 to be received within power cord hanger 150 more efficiently.

In a preferred form, power cord 150 hanger is mounted on first wing 122. Within first wing 122, cord ridge 160 is present to receive, or to have mounted therein, power cord hanger 150. Cord ridge 160 provides a rectangularly cross-sectioned indentation 162 extending substantially vertically up first wing 122. Power cord 114 is placeable between cord hanger 150 and first wing 122. Such a structure provides a clear molding advantage for producing the vacuum cord and hose support 180.

Centered in base 120 is a cylindrical female receptacle 153 centered within. Female receptacle 153 extends up in the same direction as wings 122 and 124.

Figure 4:
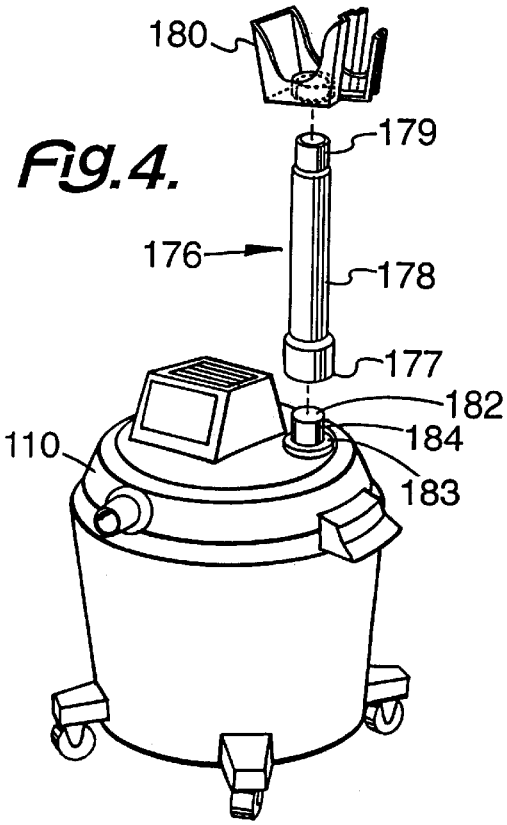
FIG. 4 depicts a bottom perspective view of vacuum hose and cord support 180.

In FIG. 4, another preferred embodiment of the vacuum cord and hose holder is shown. The wand 176 consists of a female receptacle 177; column 178 and male extension 179. Male extension 179 fits into the female receptacle centered in the base of the cord and hose support. Mount 182 consists of a flat disk 183 with a male extension 184 centered upon the disk and protruding out at a 90° angle from the disk. The mount 182 may be attached to the vacuum cleaner 110 in any suitable fashion. The male extension 184 is sized to fit into either the standard hose extension female receptacle 177 or the female receptacle centered in the base of the cord and hose support.

Figure 5:
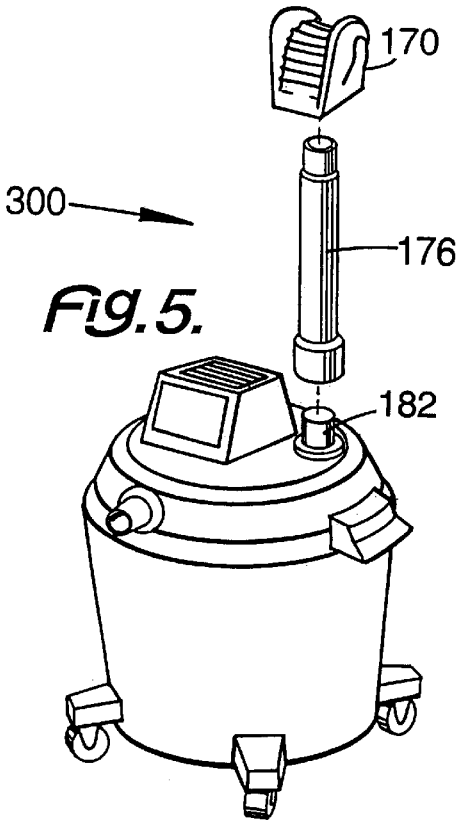
FIG. 5 depicts an extended height view 300 of fluted vacuum hose and cord support 170 mounted upon the vacuum cleaner 110, shown as exploded.
Figure 6:
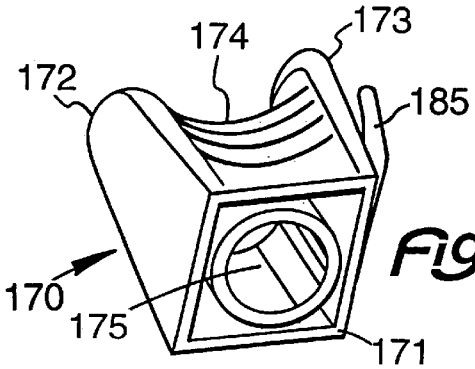
FIG. 6 depicts a bottom, perspective view of fluted vacuum hose and cord support 170.

In FIG. 5, a preferred embodiment of fluted vacuum cord and hose support is displayed. Fluted vacuum cord and hose support 170 has a base 171 that is preferably rectangular in shape, although other shapes are operable. Extending upwardly from base 171 is an elliptical plane 172. Oppositely disposed from elliptical plane 172 is a second elliptical plane 173. Situated between the two elliptical planes 172 and 173 is a hose cradle 174. Extending out at an angle from elliptical plane 172 is cord ridge 185 (FIG. 6). Centered in base 171 is a cylindrical female receptacle 175 centered within. Female receptacle 175 extends up in the same direction as elliptical planes 172 and 173.

FIG. 6 shows a preferred embodiment of the vacuum cord and hose holder 200 with cord and hose support 185, wand 176 and mount 182.

Figure 7:
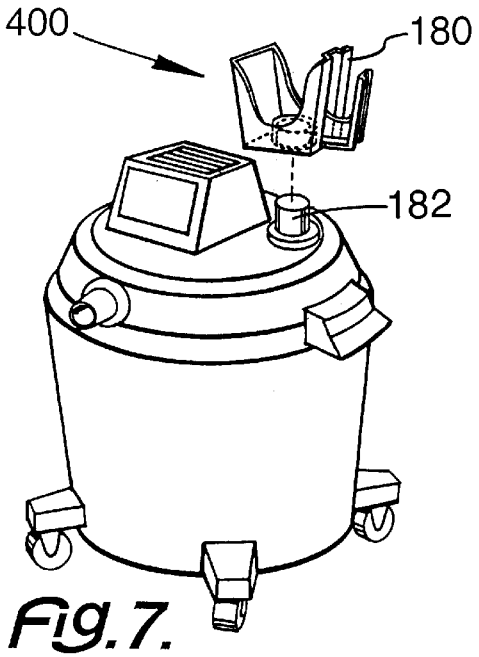
FIG. 7 depicts a perspective view of vacuum hose and cord holder 180 mounted on vacuum cleaner 110.

FIG. 7 shows a preferred embodiment of a first direct vacuum cord and hose holder assembly 400 with pyramidal cord and hose support 180 cooperating with mount 182 alone.

Figure 8:
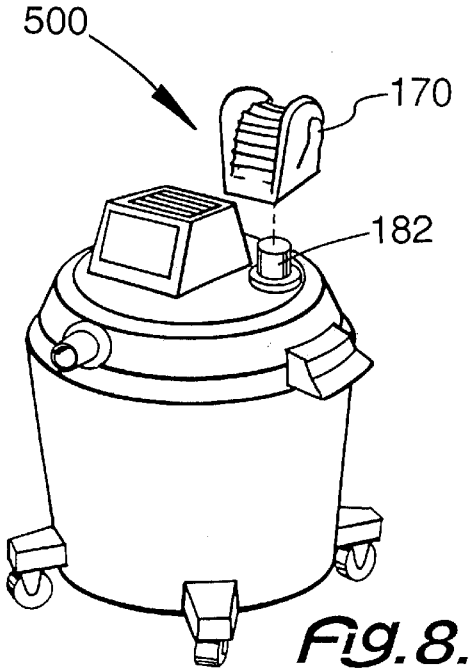
FIG. 8 depicts a perspective view of fluted vacuum hose and cord support 170 mounted on vacuum cleaner 110.

FIG. 8 shows a preferred embodiment of a second direct vacuum cord and hose holder assembly 500 with pyramidal cord and hose support 180 cooperating with mount 182 alone.

This application; taken as a whole with the specification, claims, abstract, and drawings; provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A vacuum cord and hose holder for keeping a hose and a cord of a vacuum cleaner in position for either use or for providing ease of storage, comprising a cord and hose support, a wand for the cord and hose support, a vacuum mounting device on a first end of the hose extension to receive the vacuum cleaner and a holder receiving device on a second end of the wand to receive the cord and hose support.

2. The vacuum cord and hose holder of claim 1 wherein the hose support further comprises:

(a) a base with a pair of oppositely disposed wings extending therefrom providing of storage of the hose for the vacuum cleaner;

(b) a cord ridge being mounted on the cord and hose support for receiving a cord hanger and providing for storage of the cord of the vacuum cleaner.

3. The vacuum cord and hose holder of claim 2 wherein the hose support further comprises:

(a) the pair of oppositely disposed wings including a first wing and a second wing creating a pair of oppositely disposed slots being adapted to receive the hose therebetween;

(b) the cord hanger being mounted on the cord and hose support and adapted to provide support for the cord in cooperation with the ridge.

4. The vacuum cord and hose holder of claim 3 wherein the hose support further comprises:

(a) the pair of oppositely disposed slots including a first slot and a second slot combining to support the hose in a stored position, by receiving the hose therebetween; and (b) the cord hanger being on the first wing.

5. The vacuum cord and hose holder of claim 4 wherein the hose support further comprises:

(a) the first slot and second slot have tapered edges; and (b) the first slot and the second slot provide two pairs of ribs adapted to receive the hose therebetween.

6. The vacuum cord and hose holder of claim 5 wherein the hose support further comprises:

(a) the first slot and the second slot being parabolic, arcuate slots;

(b) the first slot and the second slot being similar in shape; and (c) the first slot and the second slot having intersecting axes of symmetry.

7. The vacuum cord and hose holder of claim 6 wherein the hose support further comprises:

(a) the cord hanger extending from the first wing;

(b) the cord hanger having a wing base and a cord arm;

(c) the wing base providing a space for the cord arm on the first wing; and (d) the cord arm extending upwardly from the wing base.

8. The vacuum cord and hose holder of claim 7 wherein the hose support further comprises:

(a) a hanger buttress connecting the first wing, the cord arm and the wing base;

(b) the cord ridge being present in the first wing;

(c) the cord hanger extending from the cord ridge; and (d) the cord ridge supporting the cord hanger.

9. The vacuum cord and hose holder of claim 8 wherein the hose support further comprises:

(a) the hanger buttress including a top arc in order to permit the cord to be received within the cord hanger; and (b) a fastening means being adapted to connect the vacuum cord and hose holder to the vacuum cleaner.

10. The vacuum cord and hose holder of claim 9 wherein the hose support further comprises:

(a) an attaching means for securing a disk attached to the vacuum cleaner;

(b) a male extension projecting from the disk; and (c) the male extension projecting from the disk receiving the hose extension for the cord and hose support.

11. The vacuum cleaner of claim 10 wherein the hose support further comprises:

(a) a female receptacle sized to receive the male extension on the disk;

(b) the wand mounted thereon; and (c) the male extension sized to fit into the female receptacle.

12. In a shop vacuum having a storage device for both a vacuum hose and a power cord of the shop vacuum, the storage device including a cord and hose support for keeping the vacuum hose and the power cord in position for either use or for providing ease of storage, the improvement comprising a hose extension for the cord and hose support, a vacuum mounting device on a first end of the hose extension to receive the shop vacuum and a holder receiving device on second end of the hose extension to receive the cord and hose support.

13. The shop vacuum of claim 12 wherein:

(a) the cord and hose support has a base with a pair of oppositely disposed wings extending therefrom in order to provide for storage of the hose cleaner; and (b) a cord hanger is mounted on the cord and hose support providing for storage of the cord.

14. The shop vacuum of claim 13 wherein (a) the pair of oppositely disposed wings includes a first wing and a second wing thereby creating a pair of oppositely disposed slots adapted to receive the vacuum hose therebetween; and (b) the cord hanger being mounted on the cord and hose support adapted to provide support for the cord.

15. The shop vacuum of claim 14 wherein:

(a) the oppositely disposed slots include a first slot and a second slot; the first slot and the second slot combining to support the hose in a stored position, by receiving the hose therebetween; and (b) the cord hanger being on the first wing.

16. The shop vacuum of claim 15 wherein:

(a) the first slot and second slot having tapered edges; and (b) the first slot and the second slot providing two pairs of ribs adapted to receive the hose therebetween.

17. The shop vacuum of claim 16 wherein:

(a) the first slot and the second slot are parabolic, arcuate slots;

(b) the first slot and the second slot are similar in shape; and (c) the first slot and the second slot have intersecting axes of symmetry.

18. The shop vacuum of claim 17 wherein:

(a) the cord hanger extends from the first wing;

(b) the cord hanger has a wing base and a cord arm;

(c) the wing base providing a space for the cord arm on the first wing; and (d) the cord arm extending upwardly from the wing base.

19. The shop vacuum of claim 18 wherein:

(a) a hanger buttress connects the first wing, the cord arm and the wing base;

(b) a cord ridge is present in the first wing;

(c) the cord hanger extending from the cord ridge; and (d) the cord ridge extending into the cord hanger.

20. The shop vacuum of claim 19 wherein:

(a) the hanger buttress includes a top arc in order to permit the cord to be received within the cord hanger; and (b) a fastening means being adapted to connect the cord and hose support to the shop vacuum.

* * * * *